United States Patent [19]

Federico

[11] Patent Number: 5,033,669

[45] Date of Patent: Jul. 23, 1991

[54] COLLAPSIBLE BOX FOR HOLDING ARTICLES IN GENERAL

[76] Inventor: Gonella Federico, Via Lacaita, 2, 20139 Milan, Italy

[21] Appl. No.: 549,618

[22] Filed: Jul. 9, 1990

[30] Foreign Application Priority Data

Jul. 27, 1989 [IT] Italy ..... 21520 B/89

[51] Int. Cl.[5] ..... B65D 5/44

[52] U.S. Cl. ..... 229/198.1; 220/642; 229/199

[58] Field of Search ..... 229/198.1, 198.3, 199, 229/DIG. 11; 220/640, 642, 643; 206/821

[56] References Cited

U.S. PATENT DOCUMENTS

| | | | |
|---|---|---|---|
| 775,090 | 11/1904 | Pilz | 229/198.1 |
| 2,191,291 | 2/1940 | Smith | 220/642 |
| 2,544,283 | 3/1951 | Snyder | 229/199 |
| 2,954,914 | 10/1960 | Herlihy | 229/199 |
| 3,659,774 | 5/1972 | Mielke | 229/199 |
| 4,624,380 | 11/1986 | Wernette | 229/199 |
| 4,807,756 | 2/1989 | Young et al. | 206/821 |

FOREIGN PATENT DOCUMENTS

| | | | |
|---|---|---|---|
| 704105 | 4/1966 | Italy | 229/198.1 |

*Primary Examiner*—Gary E. Elkins
*Attorney, Agent, or Firm*—Bucknam and Archer

[57] ABSTRACT

A collapsible box for holding articles in general comprises a die-cut body including a central portion from which extend folding perimetrical side walls which can be upwardly folded with respect to the central portion, to be brought to an erected condition for forming a box body. The collapsible box further includes a top plastics material frame, defining and engaging slot in which the free edge portions of the erected side walls can be snap engaged.

2 Claims, 3 Drawing Sheets

COLLAPSIBLE BOX FOR HOLDING ARTICLES IN GENERAL

BACKGROUND OF THE INVENTION

The present invention relates to a collapsible box for holding articles in general.

As is known there are commercially available box structures which are conventionally used for holding articles of any types, and in which said articles are orderly arranged.

These box structures are at present made starting from paper die-cut sheets, which are shaped according to complex patterns so as to allow the side faces to be coupled at corner portions.

The coupling of the side faces or walls is usually performed by means of press buttons, rivets, staples and the like which, in a lot of cases, prevent the box from being collapsed as it is not used.

Another drawback is that the mechanical strength of the mentioned known box-structures is very small since the coupling of the box parts is performed on regions of the paper material which can be easily broken.

SUMMARY OF THE INVENTION

Accordingly, the aim of the present invention is to overcome the above mentioned drawbacks, by providing a collapsible box structure, for holding articles in general, which can be assembled in a very reduced time, without using assembling tools.

Within the scope of the above mentioned aim, a main object of the present invention is to provide a box structure having a very high mechanical strength.

Another object of the present invention is to provide a collapsible box structure which can be made from a very simple die-cut element and which can be easily and quickly brought to a folded not use condition.

Yet another object of the present invention is to provide a collapsible box structure which can be easily made starting from easily available elements and materials and which, moreover, is very competitive from a mere economic standpoint.

According to one aspect of the present invention, the above mentioned aim and objects, as well as yet other objects, which will become more apparent hereinafter, are achieved by a collapsible box structure for holding articles in general, characterized in that said box structure comprises a die-cut body, defining a central portion, with the perimeter of which there are associated folding side walls which can be folded with respect to said central portion, there being moreover provided a substantially rigid frame member defining a seat for enganging therein the free edges of said side walls in order to provide a box-shape body.

BRIEF DESCRIPTION OF THE DRAWINGS

Further characteristics and advantages of the present invention will become more apparent hereinafter from the following detailed description of a collapsible box structure, for holding articles in general, which is illustrated, by way of an indicative but not limitative example, in the figures of the accompanying drawings, where.

DESCRIPTION OF THE PREFERRED EMBODIMENT

Figure 1:
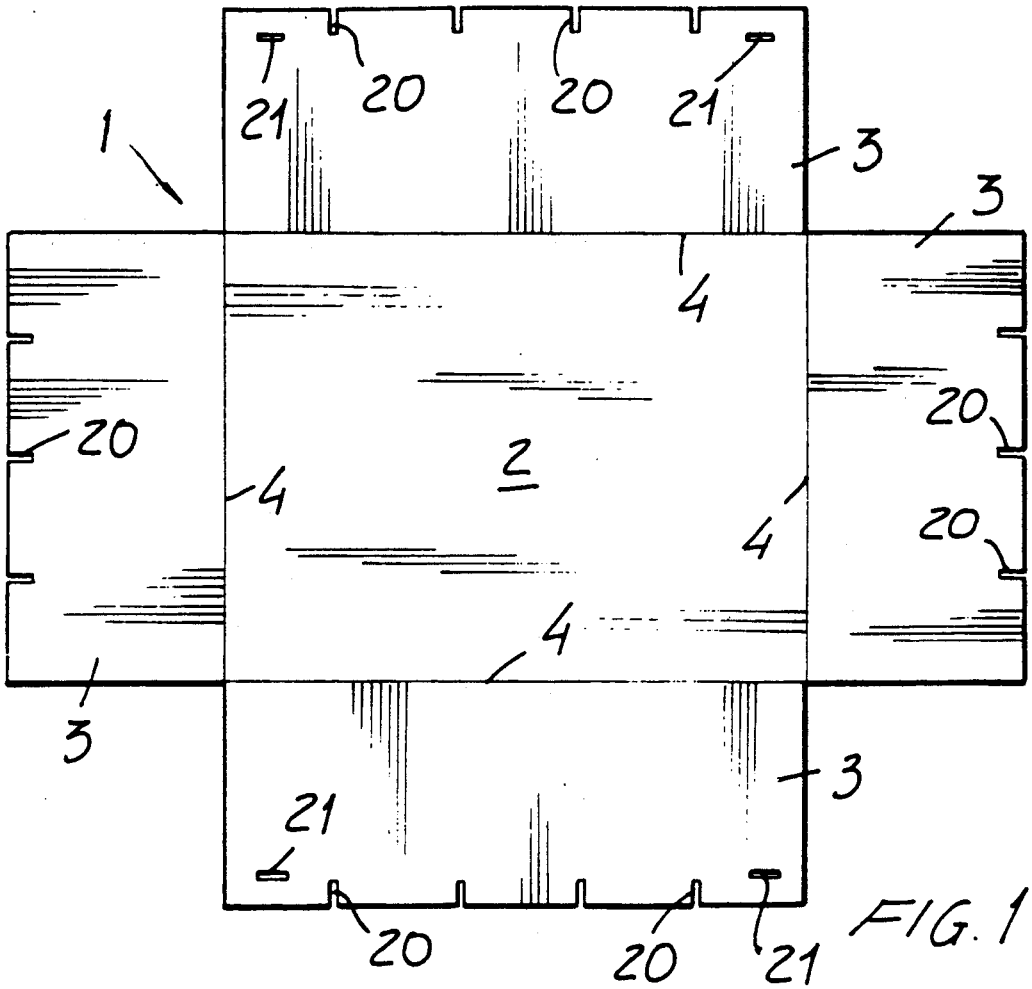
FIG. 1 is a schematic top plan view of the die-cut body provided for forming the box structure according to the invention.

With reference to the figures of the accompanying drawings, the box-shape body according to the present invention, comprises a die-cut body 1 which can be made of a paper material, plastic material and the like, and which is provided with a central rectangular portion 2.

At the perimetrical edge of the mentioned portion 2 there are provided side walls 3, which are coupled to the central portion by means of folding lines 4, to allow the side walls 3 to be folded to become perpendicular to the central portion 2.

The box body according to the invention further comprises a substantially rigid plastic material frame, 10 having the same shape as the perimetrical edge of the central portion 2, said frame comprising an inner edge 11, spaced from an outer edge 12 which defines, in cooperation therewith, a seat 13 for engaging and housing therein the edge portions of the side walls 3.

Advantageously, the inner edge 11 has a width greater than that of the edge 12 and is coupled to the edge 12 by means of stiffening portions 14.

Moreover, the inner edge 11 is provided with coupling elements for coupling it to the die-cut body 1, said coupling elements comprising an engaging tooth member 15, defined on a resiliently collapsible tongue 17 in turn defined by lateral slots 18.

Correspondingly, on the free edges of the side walls 3 there are formed cut-outs 20 which can be arranged at said portions 14, as well as windows 21 therein the tooth member 15 can be resiliently engaged.

Figure 2:
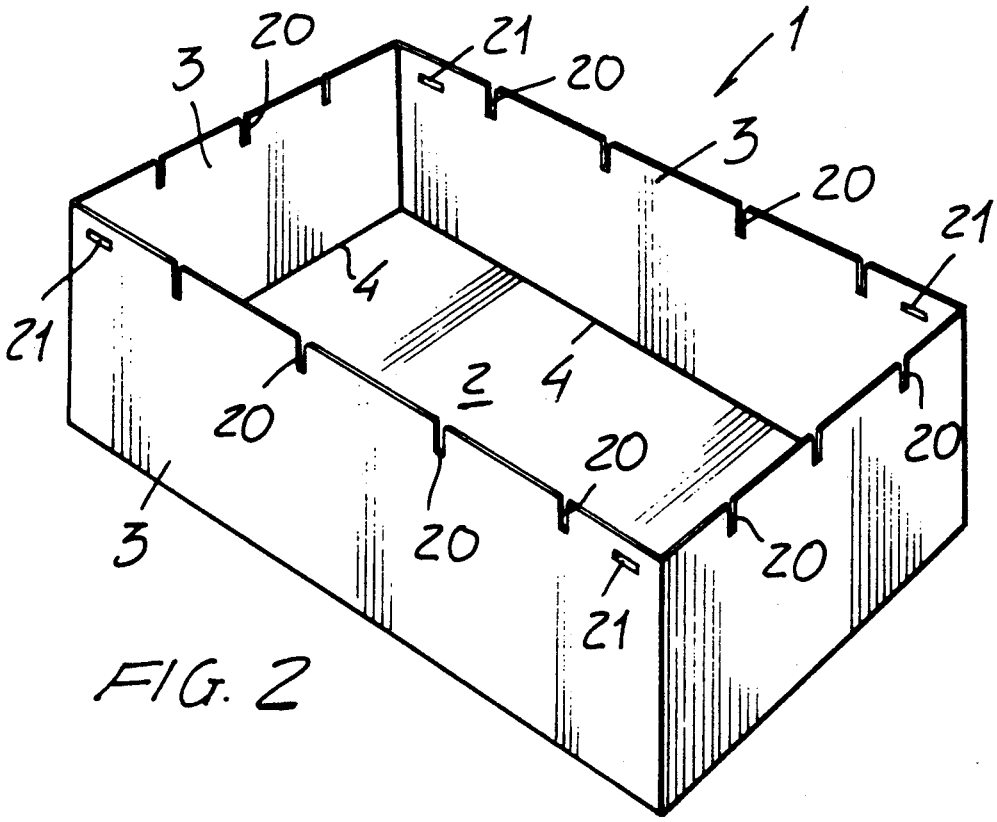
FIG. 2 is a perspective view illustrating the die-cut body with its side-walls in a folded condition so as to form the box-shape body.
Figure 3:
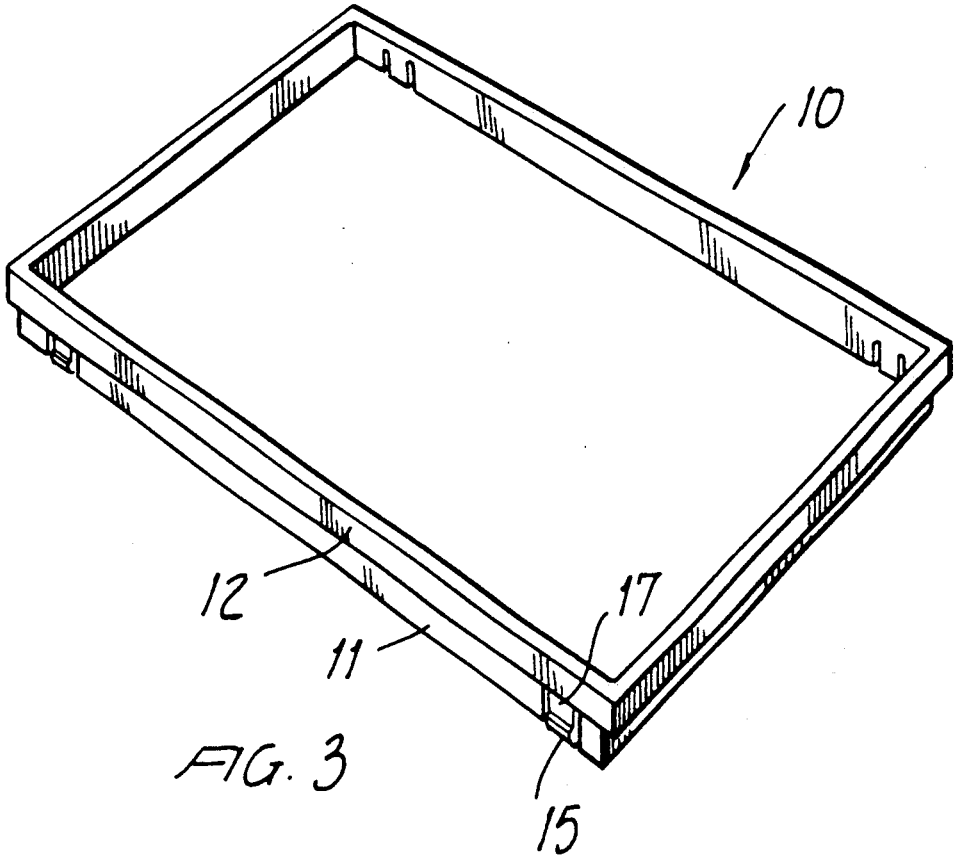
FIG. 3 is a perspective view showing a perimetrical frame member.
Figure 4:
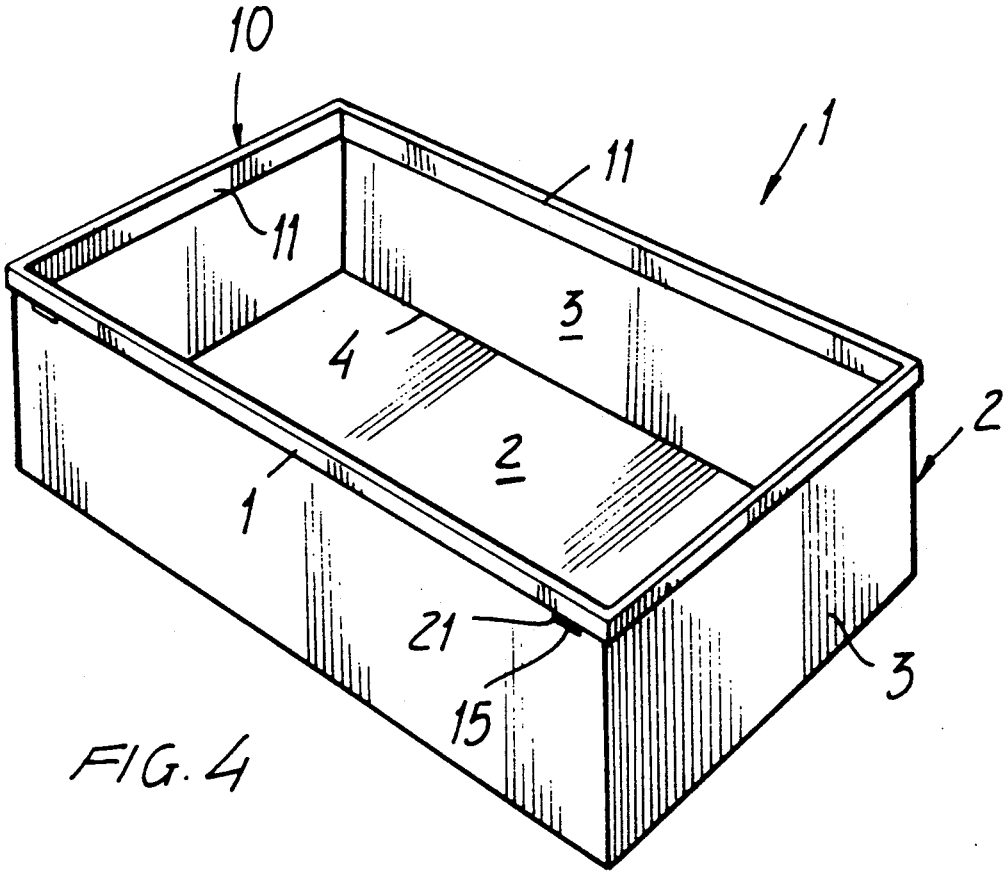
FIG. 4 is a perspective view showing the assembled box-shape body.
Figure 5:
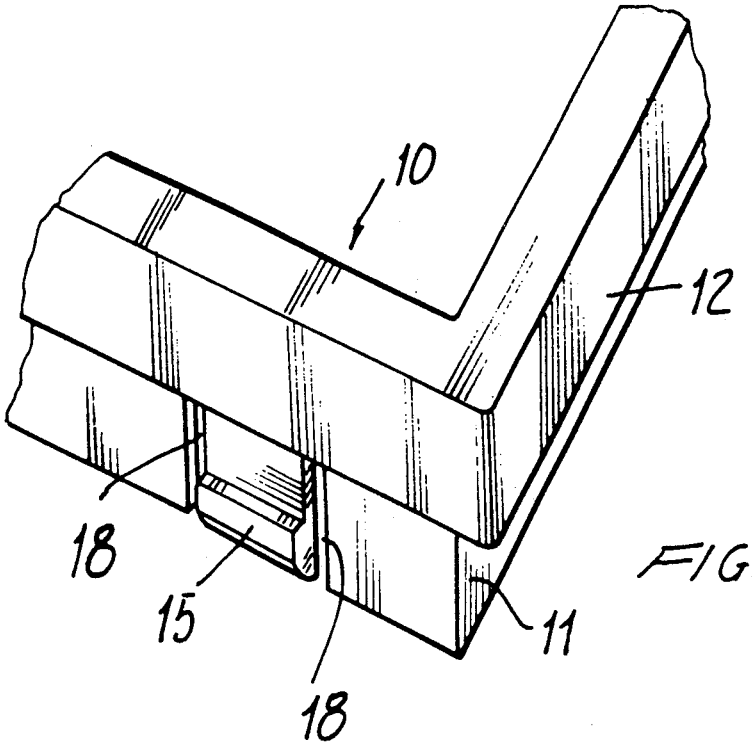
FIG. 5 shows, on an enlarged scale, a detail of the corner, seen from the outside, of the mentioned frame, there being clearly illustrated latching means therefor.
Figure 7:
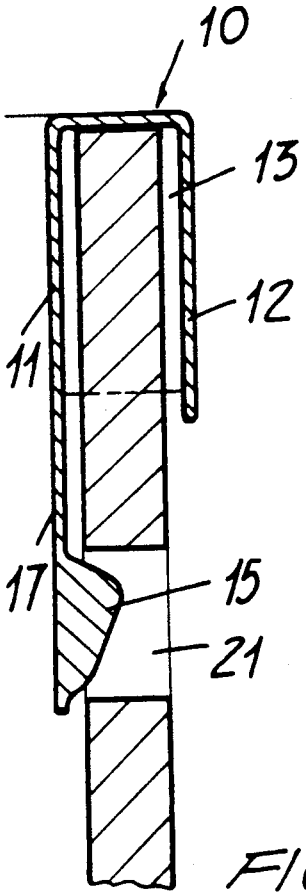
FIG. 7 is a cross-sectional view showing the coupling of said latching means to said die-cut body.
Figure 6:
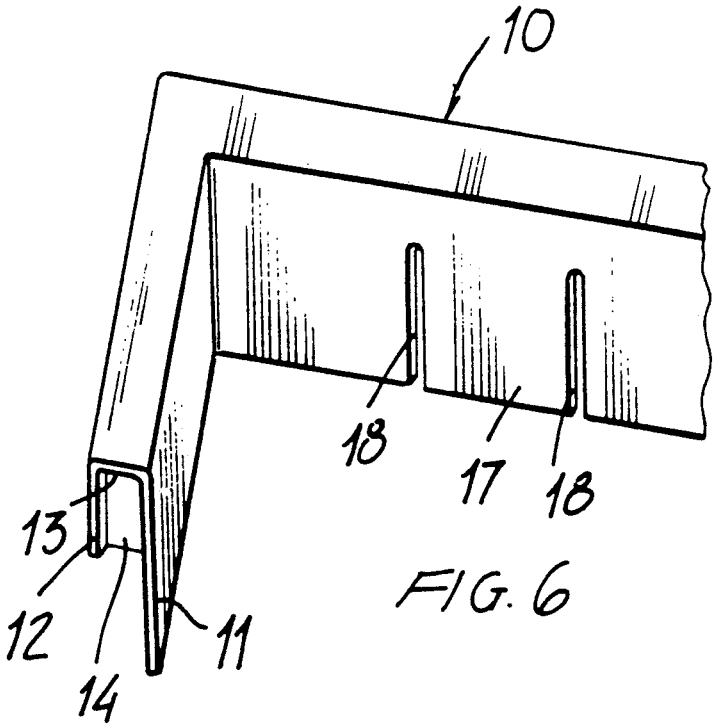
FIG. 6 is a detail view showing the corner seen from the inside.

In order to assemble the box-like according to the invention, it will be sufficient to fold the side walls, as is shown in FIG. 2, and then engage the free edges in the frame 10, to cause said edges to abut in the seat 13.

Moreover, the engagement of the tooth members 15 in the slots 21 provides a firm coupling of the frame 10 to the die-cut body, while affording the possibility of easily folding or collapsing the box body as it is not used.

The provision of the rigid frame 10, as it should be apparent, is very important since it provides a great mechanical strength, in a very simple way, while facilitating the assembling of the box.

I claim:

1. A collapsible box for holding articles in general, comprising a die-cut body, defining a central portion including perimetrical folding side walls having free edge portions and which can be folded with respect to said central portion, a rigid frame having an inner edge and an outer edge defining a seat for engaging therein said free edge portions of said side walls in order to provide a box body, said inner edge and outer edge of said frame being coupled by stiffening separating portions, coupling means being moveover provided for coupling said frame and die-cut body, said coupling means comprising a tooth member formed on a resiliently collapsible tongue member and defined by said inner edge, said tooth member being adapted to be removably engaged in slots formed on said free edge portions of said side walls.

2. A collapsible box according to claim 1, wherein said free edge portions are provided with cut-outs which can be arranged at said stiffening separating portions.

* * * * *